US005403067A

United States Patent [19]

Rajaratnam

[11] Patent Number: 5,403,067

[45] Date of Patent: Apr. 4, 1995

[54] BACK SUPPORT FOR A CHAIR OR SEAT

[75] Inventor: Kumar Rajaratnam, North Carlton, Australia

[73] Assignee: Davband Pty. Limited, Victoria, Australia

[21] Appl. No.: 39,455

[22] PCT Filed: Oct. 22, 1991

[86] PCT No.: PCT/AU91/00487

§ 371 Date: Jun. 21, 1993

§ 102(e) Date: Jun. 21, 1993

[87] PCT Pub. No.: WO92/06622

PCT Pub. Date: Apr. 30, 1992

[30] Foreign Application Priority Data

Oct. 23, 1990 [AU] Australia ..... PK2941

[51] Int. Cl.[6] ..... A47C 7/02

[52] U.S. Cl. ..... 297/230.14; 297/230.11

[58] Field of Search ..... 297/230.14, 230.11, 297/230.13, 283, 284.2, 284.3, 284.9, 350, 452.63

[56] References Cited

U.S. PATENT DOCUMENTS

| | | | |
|---|---|---|---|
| 1,975,586 | 10/1934 | Law | 297/230.11 |
| 2,504,190 | 4/1950 | Farrell | 297/230.11 X |
| 2,551,741 | 5/1951 | Hopper | 155/182 |
| 2,582,115 | 1/1952 | Goodeve | 297/230.11 |
| 2,621,714 | 12/1952 | Kiwad | 297/230.13 X |
| 2,716,443 | 8/1958 | Laughlin | 297/230.11 |
| 3,679,261 | 7/1972 | Slabakov | 297/231 |
| 4,556,254 | 12/1985 | Roberts | 297/460 |

FOREIGN PATENT DOCUMENTS

| | | | |
|---|---|---|---|
| 78335/87 | 3/1988 | Australia | A47C 7/46 |
| 741786 | 12/1955 | United Kingdom | 297/230.11 |
| 1372552 | 10/1974 | United Kingdom | A61G 5/00 |

*Primary Examiner*—Laurie K. Cranmer
*Attorney, Agent, or Firm*—Seed & Berry

[57] ABSTRACT

A back support for supporting the back of a seated person, comprising a concave shell having sides extending forwardly of the shell and straps extending between the sides to define a back support surface, the straps being of adjustable length between the sides, the arrangement being such that tension applied to the strap means causes the shell to deform whereby the back support surface conforms to the specific shape of the person's back.

7 Claims, 5 Drawing Sheets

BACK SUPPORT FOR A CHAIR OR SEAT

The present invention relates to a back support for a chair or seat.

There has been a need to convert existing seating arrangements which either do not provide proper back support or which do not provide a simple means of adjusting the back of the chair so that it does provide proper support. These needs are of particular concern to people who have existing back problems such as lower back pain, arthritis, post laminectomy/spinal fusion, a disc condition or sciatica.

According to a first aspect of the present invention there is provided a back support for supporting the back of a seated person, comprising a concave shell having sides extending forwardly of the shell and strap means extending between the sides to define a back support surface, the strap means being of adjustable length between the sides, the arrangement being such that tension applied to the strap means causes the shell to deform.

According to a second aspect of the present invention there is provided a back support for supporting the back of a seated person, comprising a semi-rigid shell having a central concave portion intermediate sides of the shell, the sides extending forwardly of the central portion, and strap means extending between the sides to define a back support surface, the strap means being of adjustable length such that it serves to define the position of the back support surface relative to the shell such that in use, when the back of a person leans against the support the resultant tension applied to the strap means causes the sides of the shell to move closer together whereby the back support surface conforms to the specific shape of the person's back thereby providing back and lateral support.

Preferably, the strap means comprises a plurality of spaced, substantially horizontal straps extending between the sides of the shell, each strap being independently adjustable in length to enable the shape of the back support surface to be selectively varied. It is also desirable that the strap means be elastic so that the back support surface provides a yielding surface.

Advantageously, the shell has apertures, which may be in the form of substantially vertical slots, proximal the outer peripheral edge of the sides for receiving the free ends of the strap means therethrough.

Conveniently, the rear of the shell has at least one transversely extending slot therethrough to provide ventilation and/or provide additional flexure to the semi-rigid shell. In a preferred form, the rear of the shell includes at least two transverse slots which are arranged to define transverse lands therebetween which may be grasped to assist in the adjusting of the strap means. Further, the or each land may carry means thereon for adjustably securing a free end portion of the strap means relative to the land.

In one preferred form, the back support may be in the form of a removable support cushion which can be placed against the back portion of an existing chair.

In another preferred form, the back support may be mounted on the seat part of a chair to thereby provide a chair back of the chair.

Embodiments of the present invention seek to provide a back support having a simple construction and one which can be easily adjusted to provide improved back support.

The invention will now be further described by way of example only with reference to the accompanying drawings in which.

Figure 1:
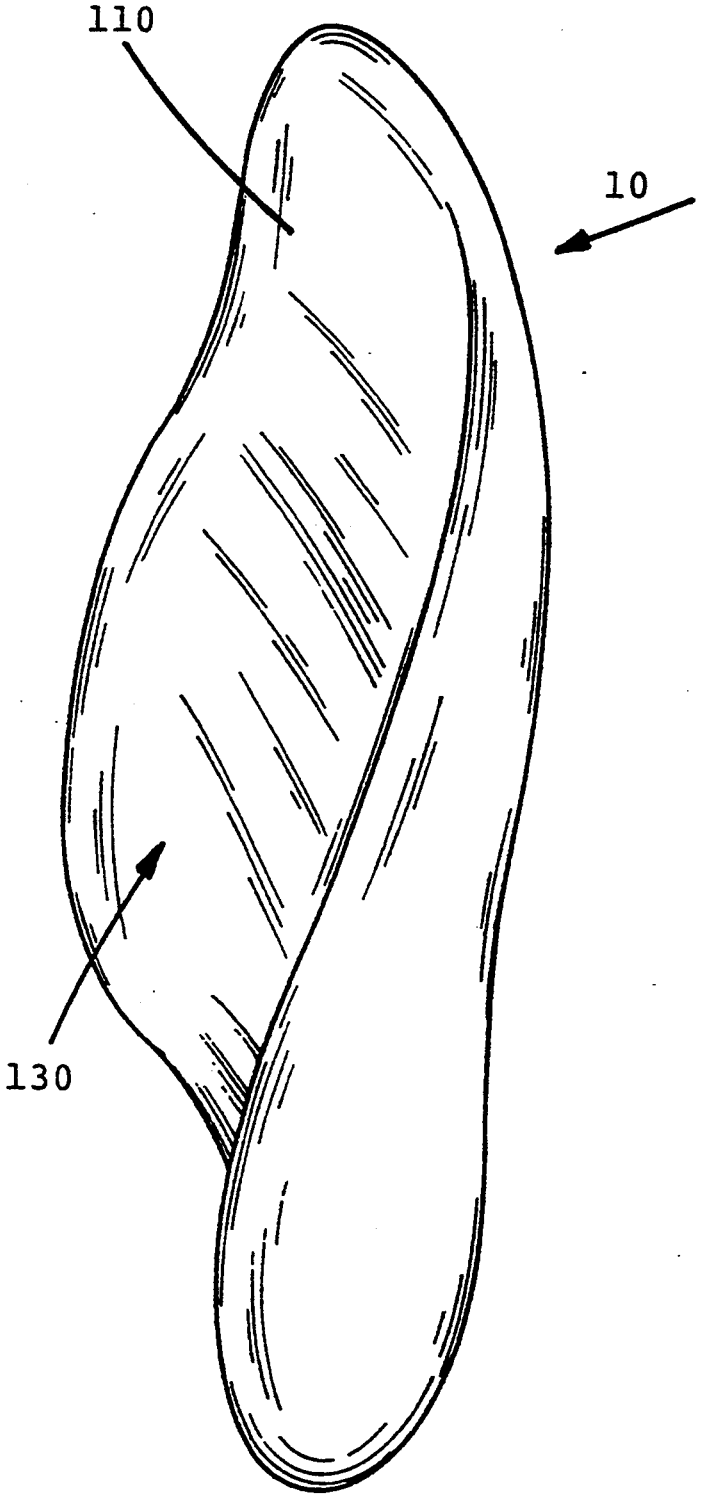
FIG. 1 is a perspective view of an embodiment of a back support of the present invention.
Figure 2:
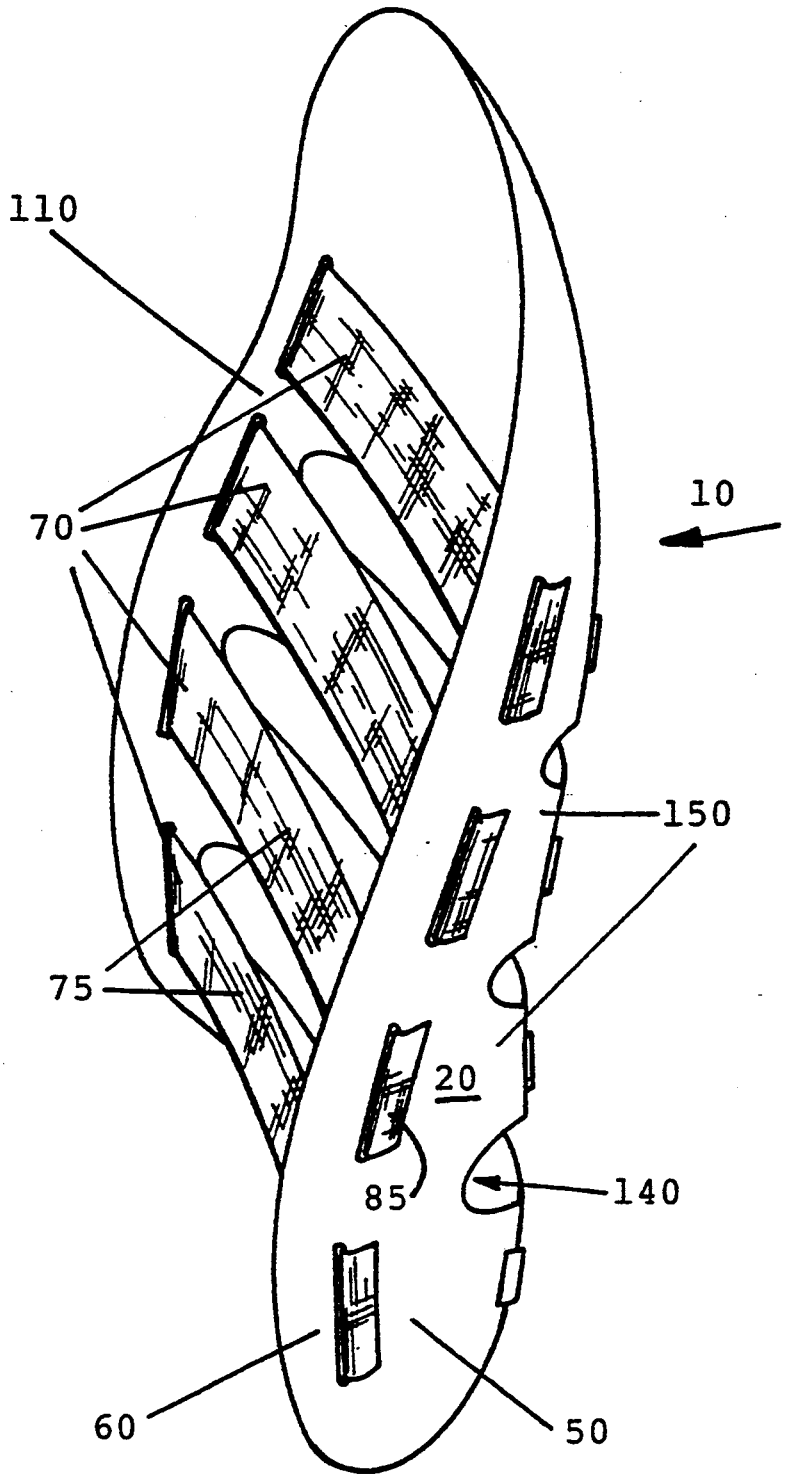
FIG. 2 is a view similar to FIG. 1, but with a protective cover and support layer removed to show the shell opening and adjustable straps.
Figure 3:
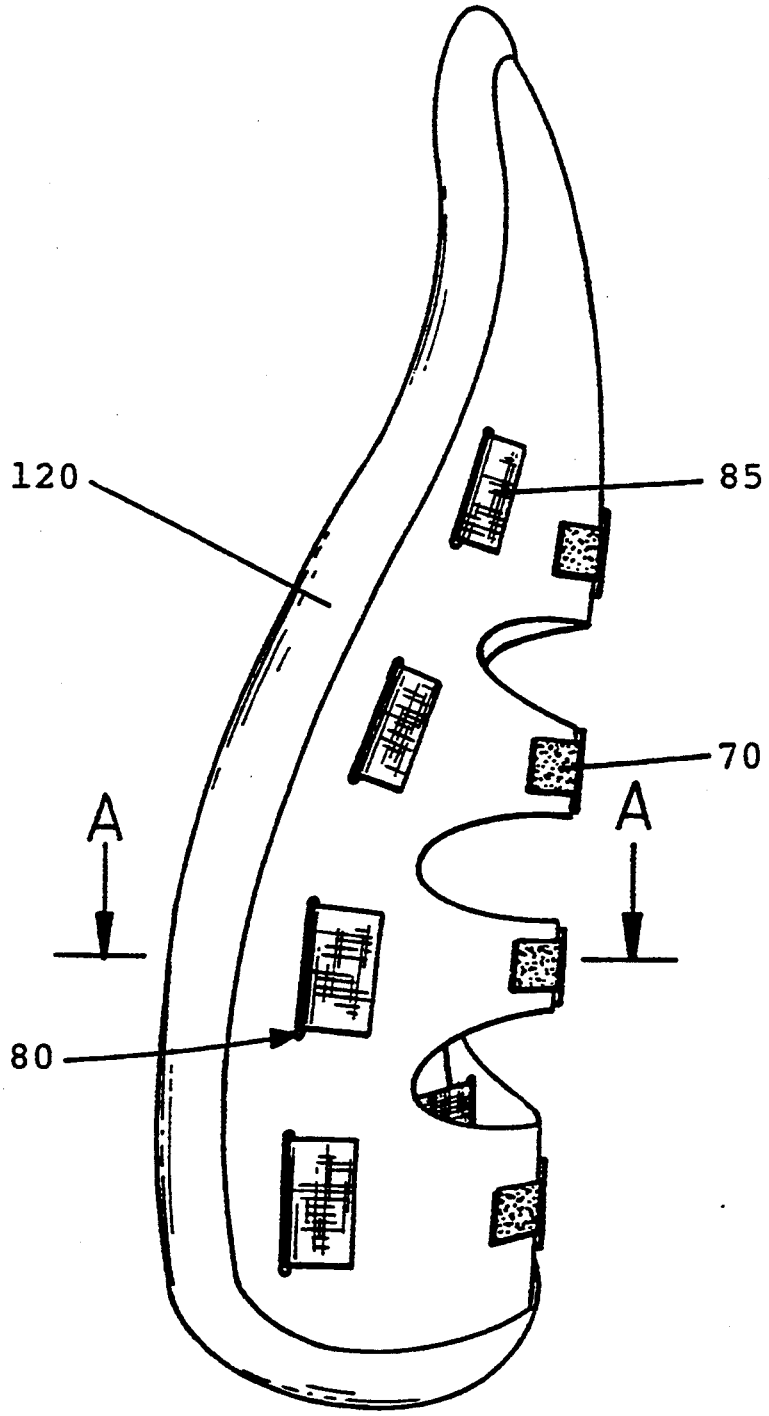
FIG. 3 is a side elevation of the embodiment of FIG. 1 with the protective cover removed.
Figure 4:
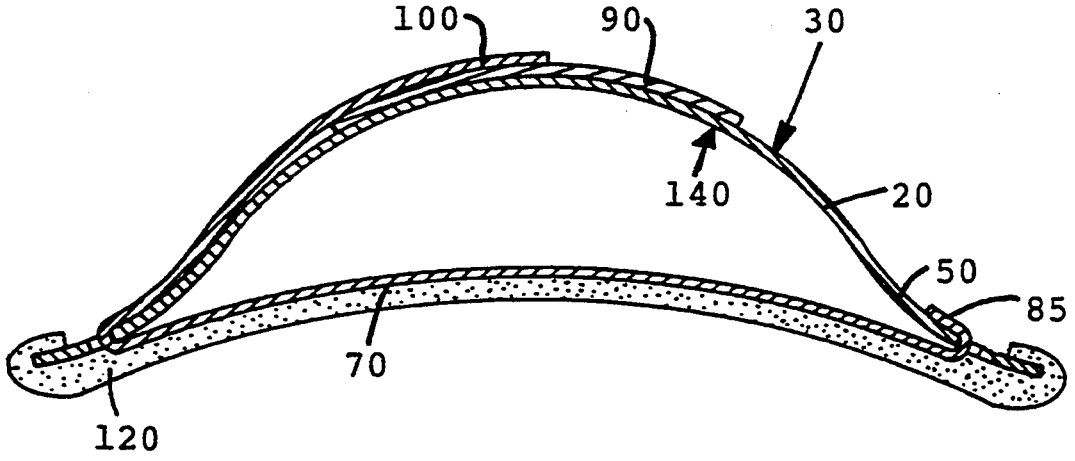
FIG. 4 is a sectional view on line A–A' of FIG. 3.
Figure 5:
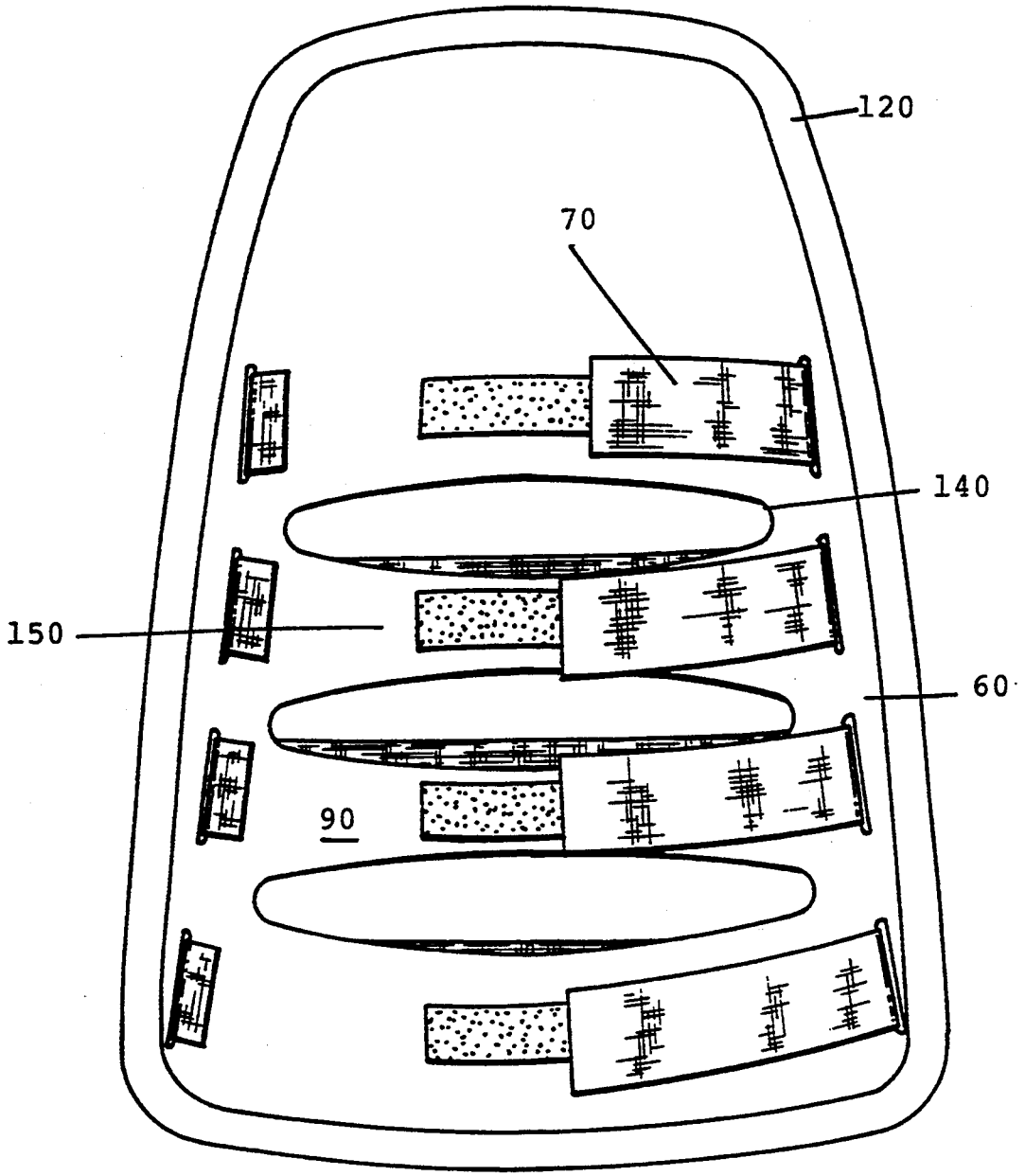
FIG. 5 is rear elevation of the back support.

Referring to FIGS. 1 and 2, the back support, generally indicated by the numeral 10, comprises a semi-rigid shell 20 which is formed of a plastics material, for example high density polypropylene, ABS (acrylonitrile butadiene styrene) or the like, which may be formed by injection moulding or other forming methods. The shell 20 is shaped to generally conform to the back of a seated person such that it substantially envelops the back and hip regions of the person. The central portion 30 of the shell 20 has a shallow longitudinal S-shape, as shown in FIGS. 2 and 3, and the shell 20, as shown in FIG. 4, has a curved horizontal cross-section whereby it provides a concave inner surface 40 for receiving the back of the person to be supported. A pair of sides 50 extend forwardly of the central portion 30.

The sides 50 are joined at opposed outer peripheral edge portions 60 by four transverse support straps 70 which are length adjustable such that when the support straps 70 are in their fully slackened condition, if a person leans against the back support 10, the back of the person is supported by the concave inner surface 40 of the central portion 30 of the shell 20. However, when the support straps 70 are shortened, the support straps 70 each provide a respective support surface 75 such that the person's weight will be carried by the support straps 70. As the person leans further back against the back support 10, the tension in the support straps 70 will increase causing the sides 50 to flex inwardly thereby substantially encapsulating the person's back and hip regions to provide the required back and lateral support. It is, of course, feasible to have any number of support straps 70, the number being dependent on their width, their spacing and on the height of the back support 10. Thus, by selectively adjusting the length of each of the individual support straps 70, the desired amount of lateral and back support can be increased or decreased at specific locations along the length of the person's back.

The support straps 70 may be formed of nylon webbing, leather or a like material, but it is preferable that they be formed of an elastic material such that they tend to yield. The ability of the support straps 70 to yield, in combination with the inherent resilience of the shell 20 provides a back support surface 75 which is firm but which tends to absorb vibration and high frequency shock loads thereby providing additional comfort for the end user while also providing lateral support for the back. This is of particular importance if the back support 10 is to be used in a motor vehicle.

In the preferred embodiment each support strap 70 extends through respective opposed apertures or slots 80 which are formed in the outer peripheral edge portions 60 of the sides 50 to enable the support straps 70 to, at least partly, girdle the shell 20. One end 85 of the support strap 70 is fixed to the rear surface 90 of the shell 20 and a free end portion 100 of the support strap 70 is adjustably secured relative to the rear surface 90 of the shell 20. The free end portion 100 may be adjustably secured, for example, by a two part fastening comprising a multiplicity of loops engageable with a multiplicity of hooks such as is sold under the registered trade mark "Velcro". A strip of one part of the fastening is fixed to the rear surface 90 of the shell 20 and a cooperating strip of material is attached to the free end portion 100 of the support strap 70 whereby the free end portion 100 may be selectively positioned following adjustment of the length of the support strap 70. Rather than using "Velcro" (registered trade mark), as previously described, the free ends of each support strap 70 may be adjusted for length and the joined by way of a conventional buckle arrangement, D-rings or clamps (not shown). Alternatively, other means of securing the free end portion 100 of the support strap 70 to the rear surface 90 of the shell 20 may be employed, for example the free end portion 100 may have a number of holes along its length and a post may be mounted on the rear surface 90 of the shell 20 for receiving and securing the free end portion 100 of the support strap 70. It is envisaged that calibration marks may be included on the rear surface 90 of the shell 20 and/or on the free end portion 100 of the support strap 70 whereby the length of the support strap 70 may be adjusted by predetermined discrete amounts.

The opening 110 provided by the volume defined by the shell 20 is covered by a sheet of foam, preferably polyurethane, to provide a layer 120 which is fixed to the outer peripheral edge 60 of the rear surface 90 of the shell 20 by way of adhesive so that the layer 120 conceals the support straps 70 and the opening 110 to provide a smooth, continuous support surface for the back of the person to be supported. The layer 120 also acts as a cushion between the person's back and the support straps 70 thereby increasing the person's level of comfort. The layer 120 may be formed of any suitable cushioning material. A protective cover 130 may also be provided for fitting over the back support 10 to completely cover it as is well known in the upholstery art, the protective cover 130 having a resealable opening on its rear side through which the support straps 70 may be readily adjusted. This opening may be resealed in any known manner, for example my way of "Velcro" (registered trade mark) or a zipper such that if another person wishes to use the back support 10, it is a simple matter to open the protective cover 130 to adjust the length of the support straps 70 to suit the new user and then reseal the protective cover 130. It is also conceivable that the layer 120 be part of the protective cover 130 rather than being fixed to the shell 20 such that the layer 120 may be removable with the protective cover 130 for cleaning.

The rear surface 90 of the shell 20 may have a number of cut-out openings 140 therein, for example holes or transverse slots, to facilitate ventilation and to provide additional flexure of the semi-rigid shell 20, if required. The openings 140 are preferably in the form of transverse slots whereby transverse lands 150 are provided between spaced openings 140, the lands 150 providing a surface on which the means of securing the other end 100 to the rear surface 90 may be situated, for example in the preferred embodiment each land 150 has one part of a strip of "Velcro" (registered trade mark), as previously described, mounted thereon which cooperates with a second strip of "Velcro" (registered trade mark) which is attached to the free end portion 100 of the support strap 70 whereby, following selective adjustment of the length of each of the individual support straps 70 to provide the desired amount of lateral and back support, the free end portion 100 of the support strap 70 may be secured relative to the land 150.

The lands 150 also provide a convenient means by which the shell 20 may be grasped, thereby providing a point of purchase which is of assistance when one is required to pull on a support strap 70 to shortening its length.

The back support 10 may be used as a removable support cushion to be placed against the back portion of an existing chair to provide better, or more appropriate, back and lateral support for the user. To assist in maintaining the back support 10 in position on the chair, a pair of securing straps (not shown) may be provided which are attached to, and extend from, the sides of the protective cover 130. After the back support 10 has been positioned on the chair, the free end portions of the securing straps may be connected in known manner to hold it against the back portion of the chair.

Instead of acting as a support to be used in conjunction with an existing back part of a chair or seat, the back support 10 may actually form the back part itself, the back support 10 including a suitable mounting to connect the back support 10 to the structure of the chair or seat.

The invention has been described by way of example only and modifications are possible within the scope of the invention.

I claim:

1. A back support for supporting a back of a seated person, comprising a semi-rigid shell having in an unstressed state a central concave portion intermediate sides of the shell, the sides extending forwardly of the central concave portion and the sides having forward edges, and several vertically-spaced straps extending horizontally between the sides to define a back support surface, each strap being of a length which is adjustable independently of the other straps to effectively vary a position of the back support surface relative to the shell such that in use, when the back of the seated person leans against the back support surface a resultant tension is applied to the straps to cause the sides of the shell to move closer together whereby the back support surface conforms to a specific shape of the person's back thereby providing back and lateral support, each of said sides of the shell having several vertically-spaced strap receiving slots spaced inwardly from the forward edges of the sides, the slots in one of said sides being aligned with respective slots in the other of said sides to define pairs of horizontally aligned slots each receiving a respective one of said straps.

2. A support according to claim 1, wherein each of said straps is elastic.

3. A support according to claim 1, wherein the central concave portion includes at least two transverse slots which are arranged to define at least one transverse land therebetween which may be grasped to assist in the adjusting of the straps.

4. A support according to claim 3, comprising a plurality of said transverse slots to define a plurality of the lands so located that a respective one of the lands is positioned adjacent each one of the straps.

5. A support according to claim 4, wherein a respective said strap extends across each of said lands and each said land carries means for adjustably securing a free end portion of the respective strap relative to the land.

6. A support according, to claim 1, wherein the support is in the form of a removable support which is placed against the back portion of a chair.

7. A support according to claim 1, wherein the support is capable of being mounted on a seat part of a chair to provide a chair back of the chair.

* * * * *